US007261042B1

(12) United States Patent
Brooks

(10) Patent No.: US 7,261,042 B1
(45) Date of Patent: Aug. 28, 2007

(54) INSENSITIVE MUNITION DESIGN FOR SHROUDED PENETRATORS

(75) Inventor: George W. Brooks, Orlando, FL (US)

(73) Assignee: Lockheed Martins Corporation, Bethesda, MD (US)

( * ) Notice: Subject to any disclaimer, the term of this patent is extended or adjusted under 35 U.S.C. 154(b) by 326 days.

(21) Appl. No.: 10/888,818

(22) Filed: Jul. 8, 2004

(51) Int. Cl.
*F42B 14/06* (2006.01)

(52) U.S. Cl. ..... 102/521

(58) Field of Classification Search ..... 102/473, 102/520, 521
See application file for complete search history.

(56) References Cited

U.S. PATENT DOCUMENTS

| | | | | |
|---|---|---|---|---|
| 2,499,440 | A * | 3/1950 | Wood | 102/316 |
| 2,607,294 | A * | 8/1952 | Lindman | 264/40.4 |
| 2,797,892 | A * | 7/1957 | Ryan | 175/4.56 |
| 4,047,967 | A * | 9/1977 | Majidzadeh et al. | 524/4 |
| 4,109,579 | A * | 8/1978 | Carter | 102/513 |
| 4,732,782 | A * | 3/1988 | Babcock et al. | 427/427 |
| 5,158,173 | A | 10/1992 | Halsey et al. | 206/3 |
| 5,160,468 | A | 11/1992 | Halsey | 264/112 |
| 5,322,562 | A * | 6/1994 | Ellenberger et al. | 106/661 |
| D438,930 | S | 3/2001 | Schmacker et al. | D22/112 |
| 6,374,744 | B1 | 4/2002 | Schmacker et al. | 102/518 |
| 6,389,977 | B1 | 5/2002 | Schmacker et al. | 102/382 |
| 6,408,762 | B1 | 6/2002 | Schmacker et al. | 102/382 |

OTHER PUBLICATIONS

"SLAM ER Sympathetic Detonation Saddle", *"Rocketeer" newspaper at China Lake site*, (Sep. 3, 1998), pp. 1-3.

Kandell, John, et al., "Development of a Sympathetic Denotation (SD) Barrier for the Joint Stand-Off Weapon and the Technological Aspects of Pumice as a Barrier to SD", *NATO IM Workshop*, (Oct. 1, 2003), pp. 1-8.

Kandell, John, et al., "Pumice Technology (former title: Pumice as a Sympathetic Detonation Barrier)", *NDIA Munitions Symposium VII, NAWC China Lake*, (Apr.10-12, 2000), pp. 1-32.

* cited by examiner

*Primary Examiner*—Stephen M. Johnson
(74) *Attorney, Agent, or Firm*—Jeffrey D. Myers; Peacock Myers, P.C.; Timothy D. Stanley

(57) ABSTRACT

A munition and method of making same comprising at least partially surrounding a warhead with a protective barrier comprising pumice and surrounding the protective barrier with a shroud.

10 Claims, 2 Drawing Sheets

INSENSITIVE MUNITION DESIGN FOR SHROUDED PENETRATORS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field):

The present invention relates insensitive munitions and methods of making same.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Many penetrator designs are able to achieve their penetration requirements with case walls not sufficiently thick to protect them from certain threats such as bullet and fragment impact and sympathetic detonation. Eliminating or reducing these threats are necessary to producing insensitive munitions ("IM"). However, it is impractical to make the case walls sufficiently thick to prevent detonation from unplanned stimuli. To reach IM goals in the current state of the art, protective barriers are included in shipping containers and reduced sensitivity explosives are employed. The addition of protective barriers in shipping containers imposes additional weight and cost, with no added value to munition performance.

For example, pumice has been employed as a sympathetic detonation barrier, as described in U.S. Pat. No. 5,160,468, entitled "Method for Preparing a Storage Container for Explosive Rounds" and U.S. Pat. No. 5,158,173, entitled "Weapons Storage Container to Prevent Sympathetic Detonation of Adjacent Weapons", both to Halsey et al., which describe and cover the use of pumice as a tool for stopping sympathetic detonation of stored munitions. This technique is also described in Kandell et al., "Pumice as a Sympathetic Detonation Barrier", 44$^{th}$ Annual Fuze Conference, National Defense Industrial Association (2000). Kandall et al. also describe the use of pumice as a sympathetic detonation barrier in "Development of a Sympathetic Detonation (SD) Barrier for JSOW and the Technological Aspects of Pumice as a Barrier to SD," NATO IM Workshop, Oct. 1, 2003.

The present invention incorporates pumice within the munition itself by employing pumice inserts in a class of munitions known as "cased" or "shrouded". The following references are representative of the state of the art with respect to shrouded munitions: U.S. Pat. No. 6,389,977, entitled "Shrouded Aerial Bomb"; U.S. Pat. No. 6,408,762, entitled "Clamp Assembly for Shrouded Aerial Bomb"; U.S. Patent No. D438,930, entitled "Shrouded Aerial Bomb"; and U.S. Pat. No. 6,374,744, entitled "Shrouded Bomb"; all to Schmacker et al.

BRIEF SUMMARY OF THE INVENTION

The present invention is of a munition comprising: a warhead; a protective barrier comprising pumice at least partially surrounding the warhead; and a shroud surrounding the protective barrier. In the preferred embodiment, the shroud conforms substantially in shape and caliber to a preexisting munition type not comprising a shroud. The protective barrier preferably comprises pumice and epoxy (most preferably a mixture of Versamid 140 hardner and Epon 815 resin). Substantially no air exists between the warhead and the protective barrier, or between the protective barrier and the shroud.

The present invention is also of a protective barrier for a shrouded munition, the protective barrier comprising pumice and an interior surface conforming substantially to a shape of a warhead and an outer surface conforming substantially to a shape of an interior surface of a shroud of a shrouded munition. The protective barrier preferably additionally comprises an epoxy (most preferably a mixture of Versamid 140 hardner and Epon 815 resin). A thickness of from approximately ¼ inch to ⅜ inch is preferred.

The invention is further of a method of making a munition, comprising: at least partially surrounding a warhead with a protective barrier comprising pumice; and surrounding the protective barrier with a shroud. In the preferred embodiment, the shroud conforms substantially in shape and caliber to a preexisting munition type not comprising a shroud. The protective barrier preferably comprises pumice and epoxy (most preferably a mixture of Versamid 140 hardner and Epon 815 resin). After surround the warhead, substantially no air exists between the warhead and the protective barrier. After the surrounding the protective barrier step, substantially no air exists between the protective barrier and the shroud.

The invention is yet further of a method of making a protective barrier for a shrouded munition, comprising: forming the protective barrier from a material comprising pumice; substantially conforming an interior surface of the protective barrier to a shape of a warhead; and substantially conforming an outer surface of the protective barrier to a shape of an interior surface of a shroud of a shrouded munition. In the preferred embodiment, the material additionally comprises an epoxy (most preferably a mixture of Versamid 140 hardner and Epon 815 resin). The preferred thickness of the protective barrier is from approximately ¼ inch to ⅜ inch.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
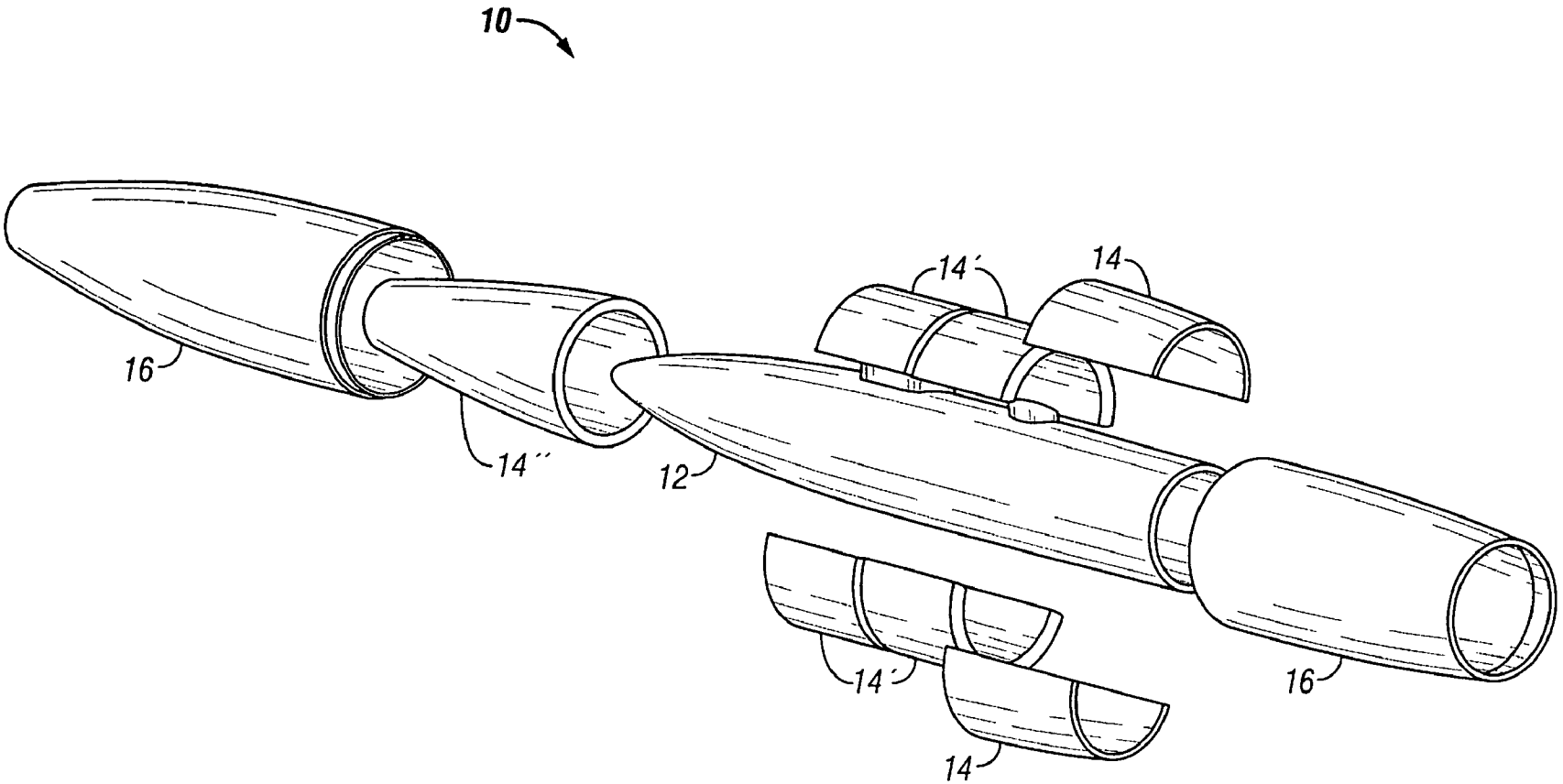
FIG. 1 is an exploded perspective view of the shrouded munition of the present invention, comprising the protective barrier of the invention.
Figure 2:
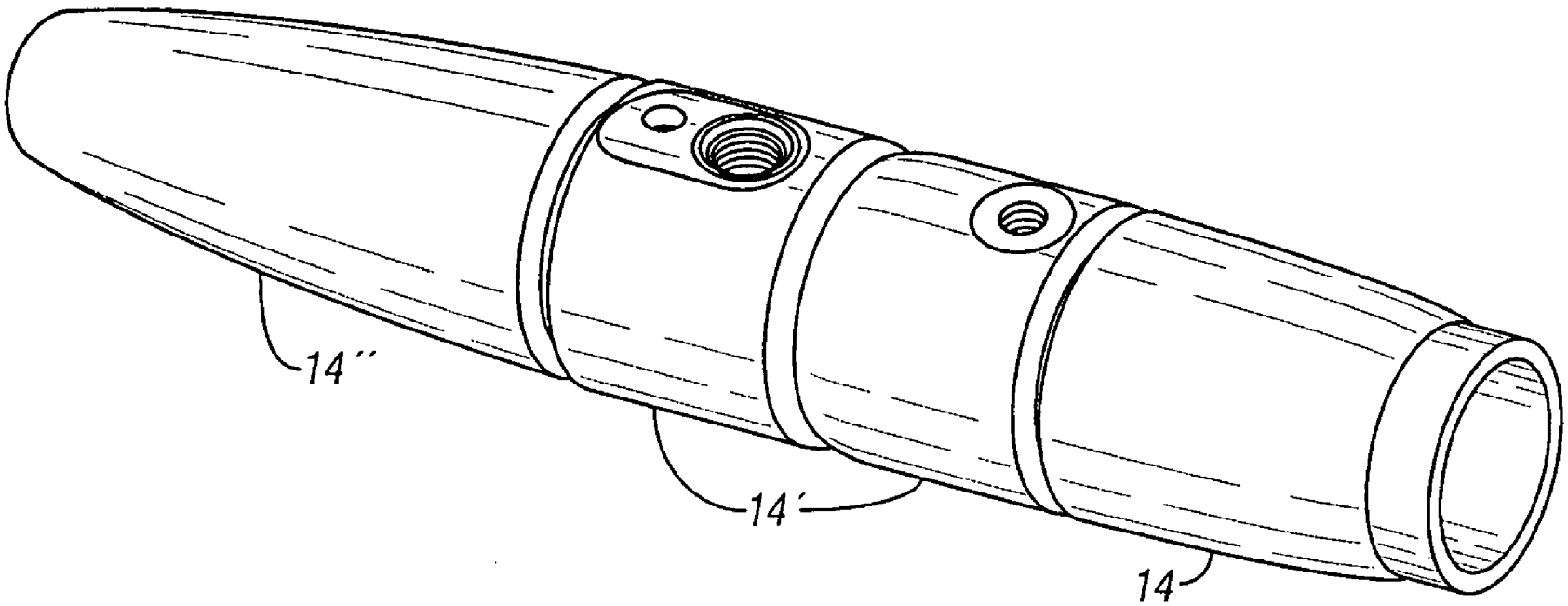
FIG. 2 is a perspective view of the protective barrier of the invention as installed on a penetrator warhead (shroud not shown).

The present invention is of an insensitive munition (and method of making same) comprising a shrouded penetrator munition incorporating pumice surrounding the penetrator warhead. In a shrouded munition, the penetrator warhead is in effect sub-caliber, being enclosed by a larger case or shroud. This is typically done such that the outer contour is the same as an existing munition so that the aircraft carriage and flight aerodynamics are the same. There is typically an air space between the penetrator warhead and the shroud interior. The present invention replaces this air space with a material comprising pumice, preferably a combination of pumice and an epoxy material. Because the shroud is stripped off during penetration of a target prior to detonation, the pumice material is stripped away as well, allowing the penetrator munition to function with its intended effects.

Pumice is a porous rock produced as a result of volcanic activity, and is comprised mostly of silica ($SiO_2$) and alumina ($Al_2O_3$). Bulk densities may vary from approximately 0.55 to 1.20 gm/cc. The material is mined from the ground, and the aggregate is sieved to obtain various sizes. The Navy has found ⅜ inch size to perform well in container barriers. For the currently disclosed application to shrouded munitions, designs preferably utilize aggregate sizes between ¼ inch and ⅜ inch, depending on the specific geometry of the configuration. The material is held together by epoxy/binder mixtures, preferably Versamid 140 hardner and Epon 815 resin in a 50/50 ratio.

Current protection methods require thicker walls to the penetrator, at greatly increased weight, and/or incorporation of protective panels in shipping containers at extra cost and weight. Of course, employing protective panels offers no protection after removal of the munition from the container, creating an extra risk for example while the munition is loaded onto aircraft.

In the preferred embodiment as shown in the Figures, the shrouded munition 10 of the invention comprises interior penetrator warhead 12, protective barrier 14,14',14" (preferably comprising pumice, most preferably a combination of pumice and epoxy), and exterior shroud 16. While the protective barrier is shown having five pieces prior to assembly (one 14" and two each of 14 and 14'), any number of pieces may be employed.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A munition comprising:

a warhead;

a protective barrier consisting essentially of pumice, an epoxy resin comprising Epon 815, and a hardener comprising Versamid 140 at least partially surrounding the warhead; and a shroud surrounding the protective barrier.

2. The munition of claim 1 wherein the shroud conforms substantially in shape and caliber to a preexisting munition type not comprising a shroud.

3. The munition of claim 1 wherein substantially no air exists between the warhead and the protective barrier.

4. The munition of claim 3 wherein substantially no air exists between the protective barrier and the shroud.

5. The munition of claim 1 wherein the protective barrier has a thickness of from approximately ¼ inch to ⅜ inch.

6. A method of making a munition, the method comprising the steps of:

at least partially surrounding a warhead with a protective barrier consisting essentially of pumice, an epoxy resin comprising Epon 815, and a hardener comprising Versamid 140; and surrounding the protective barrier with a shroud.

7. The method of claim 6 wherein the shroud conforms substantially in shape and caliber to a preexisting munition type not comprising a shroud.

8. The method of claim 6 wherein after the surrounding a warhead step substantially no air exists between the warhead and the protective barrier.

9. The method of claim 8 wherein after the surrounding the protective barrier step, substantially no air exists between the protective barrier and the shroud.

10. The method of claim 6 wherein the protective barrier comprises a thickness of from approximately ¼ inch to ⅜ inch.

* * * * *

UNITED STATES PATENT AND TRADEMARK OFFICE

CERTIFICATE OF CORRECTION

PATENT NO. : 7,261,042 B1
APPLICATION NO. : 10/888818
DATED : August 28, 2007
INVENTOR(S) : George W. Brooks It is certified that error appears in the above-identified patent and that said Letters Patent is hereby corrected as shown below:

On The Title Page, Item (73), should read
Assignee: Lockheed Martin Corporation

Signed and Sealed this

Sixth Day of November, 2007

JON W. DUDAS
*Director of the United States Patent and Trademark Office*